US011247267B2

(12) United States Patent
Le Godec et al.

(10) Patent No.: US 11,247,267 B2
(45) Date of Patent: Feb. 15, 2022

(54) DEVICE FOR SINTERING BY PULSATING CURRENT AND ASSOCIATED METHOD

(71) Applicant: SORBONNE UNIVERSITE, Paris (FR)

(72) Inventors: Yann Le Godec, Paris (FR); Sylvie Le Floch, Lyons (FR); Stephane Pailhes, Lyons (FR); Jean-Michel Combes, Lentilly (FR)

(73) Assignee: SORBONNE UNIVERSITE, Paris (FR)

( * ) Notice: Subject to any disclaimer, the term of this patent is extended or adjusted under 35 U.S.C. 154(b) by 280 days.

(21) Appl. No.: 16/348,100

(22) PCT Filed: Nov. 7, 2017

(86) PCT No.: PCT/EP2017/078409
§ 371 (c)(1),
(2) Date: May 7, 2019

(87) PCT Pub. No.: WO2018/083325
PCT Pub. Date: May 11, 2018

(65) Prior Publication Data

US 2019/0275588 A1 Sep. 12, 2019

(30) Foreign Application Priority Data

Nov. 7, 2016 (FR) ..... 1660737

(51) Int. Cl.
*B22F 3/16* (2006.01)
*B30B 11/02* (2006.01)
(Continued)

(52) U.S. Cl.
CPC ..... *B22F 3/16* (2013.01); *B22F 3/03* (2013.01); *B30B 11/00* (2013.01); *B30B 11/027* (2013.01); *B22F 2999/00* (2013.01)

(58) Field of Classification Search
CPC ..... B22F 3/16; B22F 3/14; B30B 11/027
See application file for complete search history.

(56) References Cited

U.S. PATENT DOCUMENTS 3,670,137 A 6/1972 Inoue
5,989,487 A * 11/1999 Yoo ..... B22F 3/093 266/249

(Continued)

FOREIGN PATENT DOCUMENTS

EP 0535593 A1 4/1993
EP 2691551 A2 2/2014

(Continued)

OTHER PUBLICATIONS

International Preliminary Report on Patentability received for PCT Patent Application No. PCT/EP2017/078409, dated May 16, 2019, 18 pages (10 pages of English Translation and 8 pages of Original Document).

(Continued)

*Primary Examiner* — Anthony J Zimmer
*Assistant Examiner* — Jacob J Gusewelle
(74) *Attorney, Agent, or Firm* — Womble Bond Dickinson (US) LLP

(57) ABSTRACT

The present invention relates to a device (1) for sintering by pulsating current, the device (1) comprising: —a sintering cell (4) comprising two walls (14*a*, 14*b*) facing each other and defining between them a cavity (C) for receiving material to be sintered, —a press (2) arranged for moving one of the walls (14*a*, 14*b*) towards the other wall, so as to compress the material, when the material is received in the cavity (C), —means (10*a*, 10*b*) of rotating one of the walls (14*a*, 14*b*) relative to the other wall, so as to apply a torsional force to the material, when the material is compressed in the cavity (C).

23 Claims, 2 Drawing Sheets

(51) Int. Cl.
*B30B 11/00* (2006.01)
*B22F 3/03* (2006.01)

(56) References Cited

U.S. PATENT DOCUMENTS

| | | | | |
|---|---|---|---|---|
| 6,183,690 | B1 | 2/2001 | Yoo et al. | |
| 2005/0186104 | A1* | 8/2005 | Kear | C04B 35/521 419/11 |
| 2013/0133531 | A1* | 5/2013 | Belnap | C22C 1/051 100/295 |
| 2014/0362977 | A1 | 12/2014 | Tiearney et al. | |

FOREIGN PATENT DOCUMENTS

| | | | |
|---|---|---|---|
| JP | 48-035652 | B1 | 10/1973 |
| JP | 11-222607 | A | 8/1999 |
| JP | 2000-063906 | A | 2/2000 |
| JP | 2015-054341 | A | 3/2015 |
| WO | 2012/131625 | A2 | 10/2012 |

OTHER PUBLICATIONS

International Search Report and Written Opinion received for PCT Patent Application No. PCT/EP2017/078409, dated Feb. 2, 2018, 27 pages (12 pages of English Translation and 15 pages of Original Document).

Matityahu et al., "Novel experimental design for high pressure-high temperature electrical resistance measurements in a "Paris-Edinburgh" large volume press", Review of Scientific Instruments, vol. 86, 2015, p. 043902-1-043902-9.

Preliminary Research Report and Written Opinion received for French Application No. 1660737, dated Aug. 14, 2017, 13 pages (1 page of French Translation Cover Sheet and 12 pages of original document).

Zhou et al., "Fabrication and Characterization of Ultra-Fine Grained Tungsten by Resistance Sintering Under Ultra-High Pressure", Materials Science and Engineering: A, vol. 505, No. 1-2, 2009, pp. 131-135.

* cited by examiner

DEVICE FOR SINTERING BY PULSATING CURRENT AND ASSOCIATED METHOD

FIELD OF THE INVENTION

The present invention relates to a pulsed-current sintering device and a pulsed-current sintering method.

STATE OF THE ART

The sintering is a method for manufacturing a one-piece product from a powder material. The material is heated without however being melted. Under the effect of heat, the grains of the powder material are welded together, thus forming the one-piece product.

The powder material is typically compressed during its heating, so that the grains are sufficiently close to each other for their mutual welding, and/or for giving the powder material a desired shape.

The heating and compression parameters used during a sintering depend on the material to be sintered and on the properties desired to be obtained in the part resulting from the sintering.

Some materials to be sintered degrade when heated at very high temperature. This is the case, for example, of diamond which, when heated at too high temperature, is transformed into graphite and consequently loses its interesting properties, in particular its extreme hardness. Also, to sinter such materials, it is often necessary to add a metal binder to the initial powder, having the effect of limiting the hardness properties of the final material, and/or these materials are then only moderately heated but highly compressed in order to compensate for the moderate nature of this heating and to remain in their field of thermodynamic metastability.

Other materials require a high compression during their sintering in order to reveal, in the product obtained at the end of the sintering, some advantageous properties (such as a very high density).

A particular sintering method, recognized for its rate of implementation, is the pulsed-current sintering or spark plasma sintering (SPS).

The pulsed-current sintering differs from other sintering methods by the means for heating the implemented material. As indicated by the name of this particular method, the material to be sintered is traversed by a pulsed electric current. The pulsed electric current causes the appearance of electrical discharges between the grains of the material. It is these electrical discharges that, by Joule effect, heat the material and thus allow the grains to be welded together, so as to form the desired one-piece product.

Document U.S. Pat. No. 6,183,690 B1 describes for example a method for sintering a material by pulsed current. During a first step of this method, two walls between which the material is placed are relatively rotated for the purpose of discharging some particles via ducts. During a second step of this method, implemented subsequently to the first step, the two walls are brought closer to each other to apply to the material a pressure ranging from 1 MPa to 2 GPa.

However, the pulsed-current sintering includes a drawback: if the material to be sintered is too highly compressed while the material is traversed by an electric current, the electrical discharges do not appear between grains of the material, thus compromising the welding of these grains and the obtention of a one-piece product.

Therefore, the pulsed-current sintering of a material such as diamond is particularly difficult to implement.

DISCLOSURE OF THE INVENTION

An object of the invention is to quickly sinter a material requiring to be highly compressed without degrading the material or compromising the appearance of advantageous properties in the product resulting from the sintering.

It is therefore proposed a pulsed-current sintering device, the device comprising:

- a sintering cell comprising two walls facing each other and defining a recess therebetween to receive a material to be sintered,
- a press configured to move one of the walls towards the other wall, so as to compress the material, when the material is received in the recess,
- means for rotating one of the walls relative to the other wall, so as to apply a torsional stress to the material, when the material is compressed in the recess.

The fact of relatively rotating the walls and bringing them closer to each other simultaneously makes it possible to apply the torsional stress to the material. This torsional stress makes it possible to move grains of this material away from each other. Consequently, when a pulsed current is applied to the material received in the recess of the sintering cell, electrical discharges may appear, even if the material undergoes a high compression, even greater than 2 GPa; and the grains of the material can then be welded together successfully.

The sintering device proposed is thus usable for sintering successfully and very rapidly a material comprising diamond.

The proposed sintering device may further comprise the following optional characteristics, taken alone or in combination when technically possible.

The sintering device may comprise a frame, the rotating means being also configured to rotate the sintering cell relative to the frame.

The sintering device may comprise a frame, the rotating means being also configured to rotate the walls relative to the frame in two opposite directions of rotation.

The press may be configured to move one of the walls in translation towards the other wall parallel to an axis of rotation of one of the walls relative to the other wall.

The two walls may have a shape of revolution about an axis of rotation of one of the walls relative to the other wall.

The sintering cell may comprise a seal arranged so that the recess is sealingly closed by the seal and the two walls. The seal is for example made of baked pyrophyllite.

The press may comprise two anvils between which the sintering cell is arranged, at least one of the anvils being movable towards the other anvil so as to come into contact with the sintering cell and move one of the walls towards the other wall so as to compress the material, and the rotating means may comprise the two anvils.

A movable anvil may have a bore and the sintering cell have a protrusion arranged to be received in the bore when the movable anvil is moved towards the other anvil, the bore and the protrusion being of complementary shapes.

At least one of the anvils is for example made of tungsten carbide.

The sintering device may comprise two electrodes to apply the pulsed current to the material when the material is received in the recess, wherein at least one of the electrodes extends through one of the walls, and wherein an anvil comprises an electrical conductor arranged to be electrically connected to one of the electrodes.

If the two walls movable in relative rotation are upper and lower walls of the sintering cell, then the sintering cell may furthermore comprise two lateral walls facing each other and defining the recess therebetween, and the press can be configured to move one of the lower and upper walls towards the other of the lower and upper walls, and configured to move simultaneously one of the lateral walls towards the other lateral wall, so as to compress the material along two different directions when the material is received in the recess.

According to another aspect of the invention, there is proposed a pulsed-current sintering method, the method comprising steps of:

- inserting a material to be sintered into a recess defined between two walls,
- moving one of the walls towards the other wall, so as to compress the material received in the recess,
- rotating one of the walls relative to the other wall so as to apply a torsional stress to the material compressed in the recess.

DESCRIPTION OF THE FIGURES

Other features, objects and advantages of the invention will become apparent from the following description, which is purely illustrative and non-limiting and which should be read with reference to the appended drawings in which.

In all the figures, similar elements bear identical references.

The embodiments described hereinafter being in no way limiting, it will be possible in particular to consider variants of the invention comprising only one selection of described characteristics, isolated from the other characteristics described, even if this selection is isolated within a sentence comprising these other characteristics, if this selection of characteristics is sufficient to confer a technical advantage or to differentiate the invention from the state of the prior art. This selection comprises at least one characteristic, preferably one functional characteristic without structural details, or with only part of the structural details if this part alone is sufficient to confer a technical advantage or to differentiate the invention relative to the state of the prior art.

DETAILED DESCRIPTION OF THE INVENTION

Figure 1:
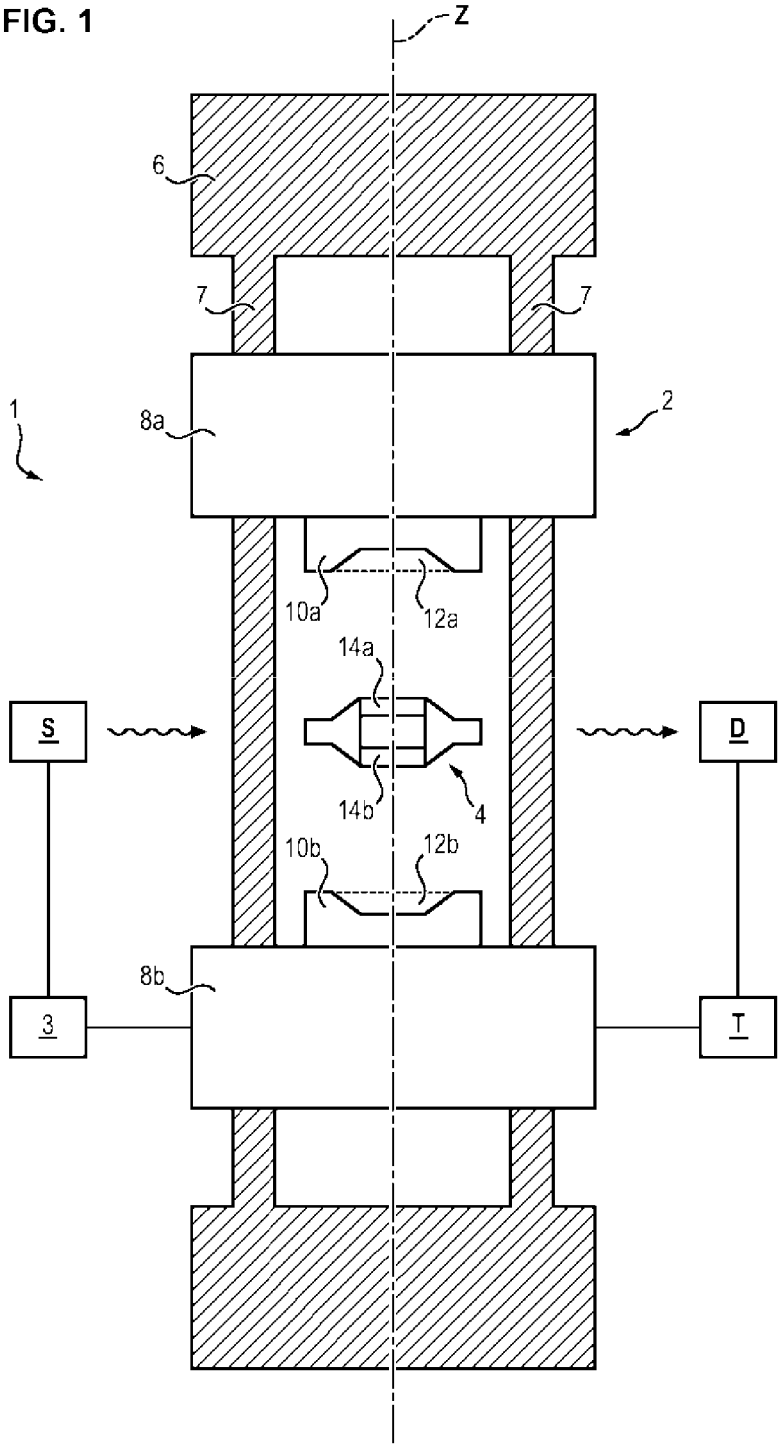
FIG. 1 is a profile view of a pulsed-current sintering device according to one embodiment of the invention.

With reference to FIG. 1, a pulsed-current sintering device 1 comprises a press 2 and a sintering cell 4.

The press 2 comprises a frame 6 and two jaws 8*a*, 8*b* arranged at distance from each other: an upper jaw 8*a* and a lower jaw 8*b*.

The frame 6 comprises a plurality of columns 7 extending parallel to an axis Z.

At least one of the jaws 8*a*, 8*b* is movable in translation parallel to the Z-axis towards the other jaw.

The two jaws 8*a*, 8*b* are each movable in translation parallel to the same Z-axis. Each of the two jaws comprises a plurality of through holes, a column 7 being engaged in each through hole. In this way, each of the two jaws slides along the plurality of columns 7.

As a variant, only one of the two jaws 8*a*, 8*b* is movable in translation relative to the frame 6 parallel to the Z-axis and the other jaw 8*b* is fixed relative to the frame 6.

The press 2 comprises means for moving one of the jaws towards the other jaw (not illustrated). These means comprise for example at least one hydraulic cylinder comprising a movable piston in a cylinder, one of the piston and of the cylinder being fixed to the frame 6 and the other of the piston and of the cylinder being fixed to a jaw 8*a* or 8*b*.

The press 2 further comprises two anvils 10*a*, 10*b* disposed between the two jaws 8*a*, 8*b*, the sintering cell 4 being arranged between the two anvils 10*a*, 10*b*.

The two jaws 8*a*, 8*b* can be brought closer to each other by relative translation along the Z-axis until the two anvils enclose and compress the sintering cell 4, when the sintering cell 4 is disposed between the two anvils 10*a*, 10*b*.

More specifically, the upper anvil 10*a* is mounted in rotation on the upper jaw 8*a* about the Z-axis. The other anvil 10*b* is mounted in rotation on the other jaw 10*b* about the Z-axis.

The device furthermore comprises means for rotating one of the anvils 10*a*, 10*b* relative to the other anvil.

The rotating means comprise, for example, a first motor (not shown) adapted to drive in rotation the upper anvil 10*a* relative to the jaw 8*a* and relative to the frame 6, and/or a second motor (not illustrated) adapted to drive in rotation the lower anvil 10*b* relative to the jaw 8*b* and relative to the frame 6. The two motors are for example respectively arranged in the two jaws 8*a*, 8*b*.

Each anvil 8*a*, 8*b* is movable relative to the frame 6 in two opposite directions of rotation.

Each anvil 10*a*, 10*b* is blocked in translation along the Z-axis relative to the jaw to which it is mounted in rotation. At least one of the two anvils 10*a*, 10*b* can be driven in translation by the jaw to which it is mounted, towards the other anvil parallel to the Z-axis.

The rotating means are furthermore configured to rotate the sintering cell 4 relative to the frame 6. Such a rotation of the sintering cell 4 may for example be obtained when the two anvils 10*a*, 10*b* are rotated in the same direction of rotation and at the same rotational speed, once the two anvils 10*a*, 10*b* firmly enclose the sintering cell 4.

The anvil 10*a* has a bore 12*a*. The bore 12*a* is oriented to face the sintering cell 4, when the sintering cell 4 is disposed between the two anvils 10*a*, 10*b*.

Similarly, the anvil 10*b* has a bore 12*b*. The bore 12*b* is oriented to face the sintering cell 4, when the sintering cell 4 is disposed between the two anvils 10*a*, 10*b*.

Each anvil 10*a*, 10*b* furthermore comprises an electrical conductor intended to be connected to a source generating a pulsed electric current 3. The electrical conductor of each anvil 10*a*, 10*b* opens into the corresponding bore 12*a*, 12*b*.

The press 2 is configured to apply a pressure ranging from 100 MPa to 5 GPa to the sintering cell 4. The pressure is for example greater than 2 GPa.

The sintering device 1 further comprises a pulsed electric current generator 3. The generator 3 is electrically connected to the electrical conductors of the anvils 10*a*, 10*b*.

The pulsed electric current generator 3 comprises for example a plurality of capacitors mounted in parallel, whose discharges are managed by a metal-oxide silicon field effect transistor (known by the acronym MOSFET). The passage or blockage of a current through the MOSFET is controlled by an electronic board. An advantage of such a pulsed generator 3 is that it is connectable to any DC power source. The generator 3 thus makes the installation autonomous, economical and small-sized in terms of its pulsed power supply. For example, when the pulsed electric current generator 3 is itself supplied with electrical energy by a source delivering voltage comprised between 0 and 7 volts and a current comprised between 0 and 300 amps, a current density of about 1000 A/cm$^3$ maximum can be delivered to the electrodes 26*a*, 26*b* via the conductors of the anvils 10*a*, 10*b*.

The sintering device 1 may further comprise at least one micrometer displacement sensor along the Z-axis configured to acquire dilatometry data of a material contained in the sintering cell 2 during the sintering of this material. For example, at least one anvil 10*a*, 10*b* comprises such a micrometric displacement sensor.

The sintering device 1 may further comprise at least one temperature sensor arranged to measure a temperature within the sintering cell 2. At least one temperature sensor is for example a thermocouple. For example, each anvil is pierced (1 mm) at its center to allow the introduction of a thermocouple into the sintering cell 2.

The sintering device 1 may also comprise, or be coupled to a device for a non-destructive testing of the material received in the recess (for example during its sintering). This testing device comprises, for example, a source S adapted to generate X-rays in the direction of the sintering cell 4. Alternatively, the source S is configured to project neutrons onto the sintering cell 4.

The testing device further comprises a sensor D arranged to acquire the rays emitted by the source S after the rays have passed through the material contained in the sintering cell 4.

The testing device 1 is fixed relative to the frame so as not to weigh down the sintering cell 4 or the press 2.

The sintering device 1 may also comprise a control unit T arranged to receive the data acquired by the sensor D.

The control unit T is configured to adjust the parameters relating to the pulsed current generated by the source (number of pulses, pulse time, intensity, etc.) based on the data acquired by the sensor D. As indicated above, this pulsed current has the effect of heating a material to be sintered. Consequently, the control unit indirectly makes it possible to adjust the heating parameters used by the sintering device 1 (setpoint temperature, heating time, etc.) based on the data acquired by the sensor D and/or the temperature sensor(s) used.

The control unit T is furthermore configured to adjust the pressure parameters used by the press 2 based on the data acquired by the sensor D.

Sintering Cell

Figure 2:
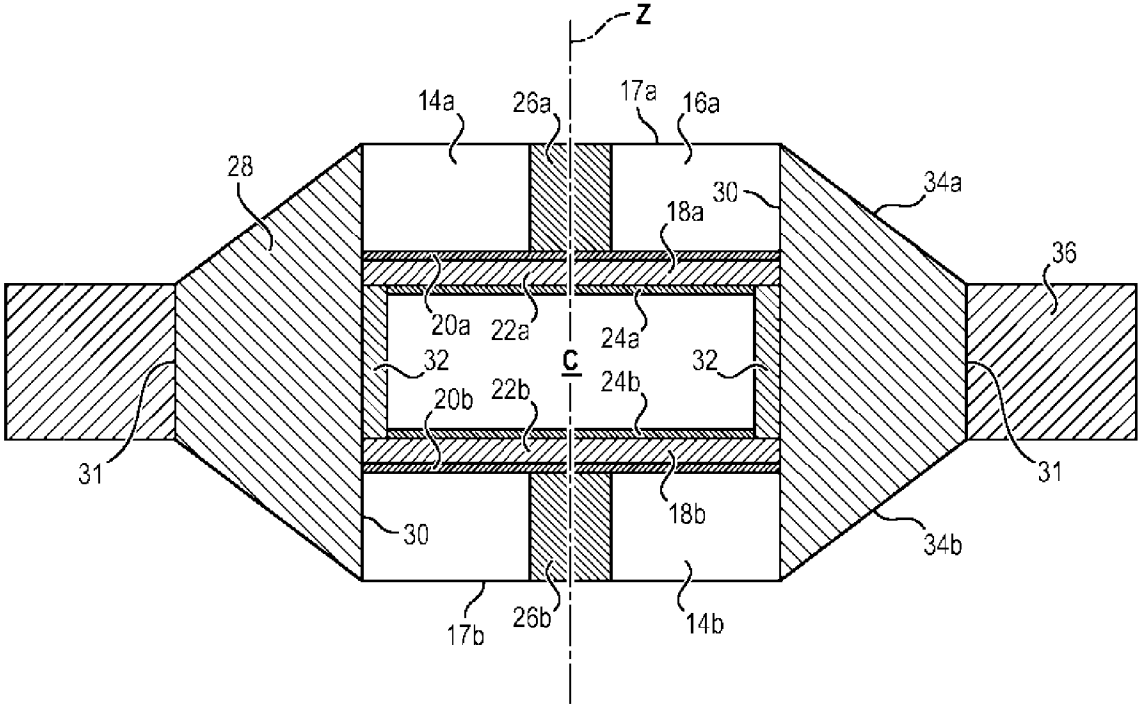
FIG. 2 is a sectional view of a sintering cell forming part of the sintering device represented in FIG. 1.

Referring to FIG. 2, the sintering cell 4 comprises two walls (an upper wall 14*a* and a lower wall 14*b*) facing each other and between which a recess C is defined to receive a material to be sintered.

The upper wall 14*a* is intended to be put into contact with the upper anvil 10*a*, so as to be driven in rotation by this anvil 10*a*.

Furthermore, the lower wall 14*b* is intended to be put into contact with the lower anvil 10*b* so as to be driven in rotation by this anvil 10*a*.

In other words, the device 1 comprises means for rotating one of the walls 14*a*, 14*b* relative to the other wall about a torsion axis; these means comprise the means for relatively rotating the two anvils 10*a*, 10*b*.

The torsion axis is the Z-axis.

Furthermore, the press 2 is configured to move one of the walls 14*a*, 14*b* towards the other wall, so as to compress a material received in the recess C along a direction of compression. The direction of compression is parallel to the Z-axis.

The upper wall 14*a* has a shape of revolution about the Z-axis.

The upper wall 14*a* comprises an outer portion 16*a* and a mold element 18*a*.

The outer portion 16*a* has a free outer surface 17*a* facing the bore 12*a* formed in the upper anvil 10*a*, and has an inner surface opposite the free outer surface 17*a*.

The outer portion 16*a* has a disk shape.

The mold element 18*b* is fixed to the inner surface of the outer portion 16*a*, and opens into the recess C.

The mold element 18*b* comprises for example three superimposed plates: an outer plate 20*a*, an intermediate plate 22*a*, and an inner plate 24*a*.

The outer plate 20*a* is fixed to the inner surface of the outer portion 16*a*.

The cavity of the mold element is formed in the inner plate 24*a*, which opens into the recess C.

The intermediate plate 22*a* is arranged between the inner plate 24*a* and the outer plate 20*a*.

The lower wall 14*b* of the sintering cell 4 comprises the same elements as the upper wall 14*a*, arranged symmetrically with respect to a plane perpendicular to the Z-axis (the numerical references of the elements of the lower wall 14*b* are conventionally the same as those of the elements of the upper wall, except that the suffix "a" is replaced by the suffix "b").

In particular, the free outer surface 17*b* of the lower wall 14*b* is facing the bore 12*b* formed in the lower anvil 10*b*.

The sintering cell 4 furthermore comprises two electrodes 26*a*, 26*b* to apply a pulsed current to a material received in the recess C.

One of the electrodes 26*a* extends through the upper wall 14*a* and opens into the free outer surface 17*a* facing the upper anvil 10*a*, so that when the upper anvil is put into contact with the sintering cell 4, the electrode 26*a* and the electrical conductor of the anvil 10*a* are electrically connected.

Similarly, the other electrode 26*b* extends through the lower wall 14*b* and opens into the surface 17*b* of the lower wall 14*b* facing the lower anvil 10*b*, so that when the anvil 10*b* is put into contact with the sintering cell 4, the electrode 26*b* and the electrical conductor of the anvil 10*b* are electrically connected.

The electrodes 26*a*, 26*b* may in this respect comprise the upper and lower mold elements 18*a*, 18*b* (in the sense that these mold elements are adapted to be traversed by a pulsed electric current so as to sinter a material in the recess C).

The cell further comprises a seal 28.

The seal 28 has an annular shape about the Z-axis.

The seal 28 forms a closed lateral wall on itself and connected to each of the upper and lower walls 14*a* and 14*b*.

The two walls 14*a* and 14*b* are each movable in rotation about the Z-axis relative to the seal 28.

The two walls 14*a* and 14*b* are furthermore movable in translation parallel to the Z-axis relative to the seal 28.

The seal 28 extends around the upper 14*a* and lower 14*b* walls, so that the recess C is sealingly closed by the upper 14*a* and lower 14*b* walls and the seal 28.

For example, the seal 28 has a shape of revolution about the Z-axis. It comprises a lateral wall closed on itself having a radially inner surface 30 relative to the Z-axis, and a radially outer surface 31 relative to the Z-axis. The lateral wall closed on itself thus comprises two lateral wall portions mutually facing each other (to the left and to the right of the recess C in the cutting plane of FIG. 2).

The radially inner surface 30 is cylindrical of revolution.

The diameter of the radially inner surface 30 is substantially equal to the diameter of the outer portions 16*a*, 16*b*, so as to seal the recess C.

At least one lateral mold element 32 is fixed to the radially inner surface.

The mold elements 18*a*, 18*b* and 32 together form a mold whose function is to give the material to be sintered, received in the recess C, a predetermined shape.

The seal 28 has a shape that tapers along a centripetal radial direction relative to a point of the Z-axis.

In other words, the height of the radially outer surface of the seal 28, measured parallel to the Z-axis, is less than the height of the radially inner surface of the seal 28, measured parallel to the Z-axis.

The seal 28 has two free surfaces 34*a* and 34*b* connecting the radially inner surface 30 to the radially outer surface 31: an upper inclined surface 34*a* and a lower inclined surface 34*b*.

The two surfaces 34*a* and 34*b* are said to be "inclined" in the sense that their profile in a plane comprising the Z-axis (the plane of FIG. 2) is generally formed at an angle comprised between 0 and 90 degrees with the Z-axis, for example between 30 and 60 degrees.

The upper inclined surface 34*a* surrounds and extends continuously the outer surface 17*a* of the upper wall 14*a*. The upper inclined surface 34*a* and the outer surface 17*a* of the upper wall 14*a* form thus together the surface of an upper protrusion likely to be received in the upper bore 12*a*.

Similarly, the lower inclined surface 34*b* surrounds and extends continuously the outer surface 17*b* of the lower wall 14*b*. The lower inclined surface 34*b* and the outer surface 17*b* of the lower wall 14*b* form together the surface of a lower protrusion likely to be received in the lower bore 12*b*.

The inclined surfaces are of revolution about the Z-axis.

The inclined surfaces 34*a*, 34*b* are for example frustoconical. Their profile in the plane of FIG. 2 is then rectilinear, for example inclined at 45 degrees relative to the Z-axis.

Each protrusion is of a shape complementary to the bore in which the protrusion is intended to be received.

In the case of inclined frustoconical surfaces, the bores are of trapezoidal profile.

The seal 28 not only ensures a function of sealingly closing the recess C, but also a function of transmitting pressure towards the recess C along two different directions: on the one hand the axis Z, and on the other hand a direction perpendicular to the Z-axis.

The sintering cell further comprises a ring 36 that surrounds the seal 28.

The ring 36 is fixed to the radially outer surface 31 of the seal 28. The function of the ring 36 is to prevent excessive elongation of the seal in a plane perpendicular to the Z-axis, when the sintering cell 4 is pressed by the two anvils along the Z-axis. In this way, the ring 36 allows the seal to withstand high pressures generated by the press 2, so that the sealing of the recess is not compromised and that the structure of the sintering cell 4 is not degraded.

Materials and Dimensions

For example, at least one of the anvils 10*a*, 10*b* is made of tungsten carbide. This material serves as an electrical conductor and also has the advantage of being very solid.

The different elements of the sintering cell 4 are adapted to be traversed by the rays emitted by the source S (X-rays or neutrons).

The seal 28 is for example made of baked pyrophyllite.

The outer plate 20*a* and/or 20*b* is for example made of tantalum.

The intermediate plate 22*a* and/or 22*b* is for example made of graphite.

The inner plate 24*a* and/or 24*b* is for example made of electrically conductive flexible graphite, for example Papyex®.

The mold elements are for example also made of graphite.

The ring is for example made of polyetheretherketone (PEEK).

The electrodes 27*a*, 27*b* may be made of molybdenum.

The outer portions 16*a*, 16*b* of the walls 14*a*, 14*b* are for example made of the material marketed under the trademark Macor®.

The sintering device 1 has reduced dimensions to the point of being portable. For example, the frame can be 84 cm high along the Z-axis, 24 cm wide and 24 cm deep.

The recess has a volume in the order of 100 $mm^3$, and/or has a diameter ranging from 7 to 8 mm.

Operation of the Sintering Device

The sintering cell 4 is opened by removal of the upper wall 14*a*.

A powder material is placed in the recess C of the sintering cell 4, via the thus formed opening.

The upper wall 14*a* is replaced in the sintering cell 4 so as to sealingly close the recess C.

The sintering cell 4 is deposited on the anvil 10*b*. More specifically, the lower protrusion of the sintering cell 4 is received in the bore 12*b* of the lower anvil 10*b* mounted in rotation on the lower jaw 10*b*. The lower electrode 26*b* is then electrically connected to the electrical conductor of the lower anvil 10*b*.

The two jaws 8*a*, 8*b* are displaced in translation towards each other parallel to the Z-axis, causing the two anvils 10*a*, 10*b* to mutually move closer to each other.

During this displacement in translation, the upper protrusion is received in the bore 12*a* of the upper anvil 10*a*. The upper electrode 26*a* is then also electrically connected to the electrical conductor of the upper anvil 10*a*.

The two anvils 10*a*, 10*b* urge the two walls towards each other, having the effect of compressing the material received in the recess C along the Z-axis.

Simultaneously, the two anvils 10*a*, 10*b* compress the seal 28 in the inclined surfaces 34*a*, 34*b*. This has the consequence of causing an elongation of the seal in a plane perpendicular to the Z-axis. As the ring 36 surrounds the seal 28, the latter can only deform in this plane perpendicular to the Z-axis inwards, therefore towards the recess C. Thus, the compression of the seal 28 by the anvils 10*a*, 10*b* causes the lateral wall portions of the seal 28 to mutually move closer to each other, and compresses the material received in the recess C along a horizontal direction, perpendicular to the Z-axis.

The material received in the recess C is thus compressed by the press 2 simultaneously in at least two different directions: a direction parallel to the Z-axis and along at least one direction perpendicular to the Z-axis.

Simultaneously, the pulsed current generator 3 is activated. A pulsed current generated by the generator 3 is thus propagated in the anvils 10*a*, 10*b*, in the electrodes 26*a*, 26*b* to which they are connected, and passes through the material received in the recess C substantially parallel to the Z-axis. One of the electrodes 26*a*, 26*b* emits electrons and the other electrode receives the electrons after passing through the recess C.

The pulsed current delivered is adapted to raise the temperature in the recess C to at least 1500 degrees Celsius.

The fact of arranging the two electrodes in the movable walls 14*a*, 14*b* makes it possible to ensure that the pulsed current cannot be delivered into the recess C provided that the two jaws 8*a*, 8*b* of the press 2 are sufficiently close to each other (so that the conductors of the anvils 10*a*, 10*b* can transmit the pulsed current delivered by the generator 3 to the electrodes 26*a*, 26*b*). Thus, as long as the jaws 8*a*, 8*b* are spaced from each other, no pulsed current can be delivered into the recess C.

Simultaneously, the means for heating the sintering device 1 are activated to heat the material received in the recess C. The heating means are for example configured to raise the temperature in the recess C to at least 1500 degrees Celsius.

Simultaneously, one of the anvils 10*a*, 10*b* is rotated relative to the other anvil.

In a first mode of operation, the two anvils 10*a*, 10*b* are rotated along two opposite directions about the Z-axis.

The upper anvil 10*a* pressed against the upper wall 14*a* adheres thereto and drives in rotation the upper plate 14*a* along a reference direction about the Z-axis.

Similarly, the lower anvil 10*b* pressed against the lower wall 14*b* adheres thereto and drives in rotation the lower plate 14*b* along a direction opposite the reference direction about the Z-axis.

This relative rotation, combined with the compression exerted by the press 2, has the effect of applying to the material compressed in the recess C a torsional stress. Thanks to this torsional stress, the grains of the material move away from each other in a plane perpendicular to the Z-axis.

In this way, even if the compression exerted by the press 2 on the material received in the recess C is very high, the grains of the material are spaced apart sufficiently for electrical discharges to occur between these grains. These electrical discharges heat the grains by Joule effect, then allowing to weld the gains of the material together and thus to obtain a one-piece product from this material.

It is also possible to rotate one of the two anvils 10*a*, 10*b* relative to the frame 6. However, the fact of rotating the two anvils 10*a* and 10*b* in opposite directions has the advantage of increasing the torsional stress while using relatively low rotational speeds of the anvils relative to the frame 6.

For example, the two anvils are rotated at identical rotational speeds (but of opposite directions) relative to the frame 6. It is however possible to rotate the anvils 10*a*, 10*b* at angular speeds of different absolute values.

Ultimately, the relative rotating of the walls 14*a*, 14*b* implemented improves the sintering conditions, especially when the material to be sintered is a composite and/or extremely hard material (for example borides).

Very high pressures can be implemented by the press 2 without compromising the occurrence of electrical discharges, and therefore the success of pulsed-current sintering. These high pressures thus make it possible to reduce the sintering heating temperature used by the device 1.

The use of pulsed current allows reducing the sintering time compared to other sintering techniques. In addition, the use of very high pressures, now allowed by the sintering device 1 because of the means for rotating the walls 14*a* and 14*b*, allows further reducing the sintering time, and therefore the energy cost of manufacture of the resulting sintered product.

In a second mode of operation of the sintering device 1, the two anvils 10*a*, 10*b* are rotated in the same direction of rotation about the Z-axis relative to the frame 6, at the same rotational speed. This has the effect of driving the complete sintering cell 4 in rotation relative to the frame 6, and therefore also driving the material received in the recess C relative to the frame 6. However, as the two walls 14*a*, 14*b* are immobile relative to each other, the material does not undergo torsional stress.

This second mode of operation is particularly advantageous for carrying out an inspection of the material being sintered, for example by means of the non-destructive testing device. The source S projects towards the cell X-ray or neutrons. Since the testing device is stationary relative to the frame 6, the rotation of the sintering cell 4 enables the sensor D to acquire complete information covering the entire volume of the material received in the recess C and traversed by rays emitted by the source S. This complete information is for example used by the control unit T to implement a tomographic analysis. The tomography allows locating defects in real time (it is for example possible to know the change of the volume of porosities, air bubbles, cracks and have a better understanding of the sintering of composite materials, etc.). Furthermore, based on the information acquired, the control unit T can adjust the heating and/or pressure parameters implemented by the device 1 during sintering, so as to obtain a sintered part without defects.

The invention claimed is:

1. A pulsed-current sintering device (1), the device (1) comprising:

a sintering cell (4) comprising two walls (14*a*, 14*b*) facing each other and defining a recess (C) there between to receive a material to be sintered, a press (2) configured to move one of the walls (14*a*, 14*b*) towards the other wall, so as to compress the material, when the material is received in the recess (C), means for rotating (10*a*, 10*b*) one of the walls (14*a*, 14*b*) relative to the other wall, so as to apply a torsional stress to the material, when the material is compressed in the recess (C), wherein:

the two walls (14*a*, 14*b*) movable in relative rotation are upper and lower walls of the sintering cell (4), the sintering cell (4) further comprises two lateral walls (28) facing each other and defining the recess (C) therebetween;

the press (2) is configured to move one of the lower (14*a*) and upper (14*b*) walls towards the other of the lower and upper walls, and configured to simultaneously move one of the lateral walls towards the other lateral wall, so as to compress the material along two different directions when the material is received in the recess (C).

2. The device according to the preceding claim, comprising a frame (6), the rotating means (10*a*, 10*b*) being also configured to rotate the sintering cell (4) relative to the frame (6).

3. The device according to claim 1, comprising a frame (6), the rotating means (10*a*, 10*b*) being configured to rotate the walls (14*a*, 14*b*) relative to the frame (6) in two opposite directions of rotation.

4. The device according to claim 1, wherein the press (2) is configured to move one of the walls (14*a*, 14*b*) in translation towards the other wall parallel to an axis of rotation (Z) of one of the walls (14*a*, 14*b*) relative to the other wall.

5. The device according to claim 1, wherein the two walls (14*a*, 14*b*) have a shape of revolution about an axis of rotation (Z) of one of the walls (14*a*, 14*b*) relative to the other wall.

6. The device according to claim 1, wherein the sintering cell (4) comprises a seal (28) arranged such that the recess (C) is sealingly closed by the seal (28) and the two walls (14*a*, 14*b*).

7. The device according to the preceding claim, wherein the seal (28) is made of baked pyrophyllite.

8. The device according to claim 1, wherein:

the press (2) comprises two anvils (10*a*, 10*b*) between which the sintering cell (4) is arranged, at least one of the anvils (10*a*, 10*b*) being movable towards the other anvil so as to come into contact with the sintering cell (4) and move one of the walls (14*a*, 14*b*) towards the other wall so as to compress the material, and the rotating means comprises the two anvils (10*a*, 10*b*).

9. The device according to the preceding claim, wherein a movable anvil (10*a*, 10*b*) has a bore (12*a*, 12*b*) and the sintering cell (4) has a protrusion arranged to be received in the bore (12*a*, 12*b*) when the movable anvil (10*a*, 10*b*) is moved towards the other anvil, the bore (12*a*, 12*b*) and the protrusion being of complementary shapes.

10. The device according to claim 8, wherein at least one of the anvils (10*a*, 10*b*) is made of tungsten carbide.

11. The device according to claim 8, comprising two electrodes (26*a*, 26*b*) for applying the pulsed current to the material when the material is received in the recess (C), wherein at least one of the electrodes (26*a*, 26*b*) extends through one of the walls (14*a*, 14*b*), and wherein an anvil (10*a*, 10*b*) comprises an electrical conductor arranged to be electrically connected to one of the electrodes (10*a*, 10*b*).

12. A pulsed-current sintering method, the method comprising steps of:

inserting a material to be sintered into a recess (C) of a pulsed-current sintering device (1), the device (1) comprising:

a sintering cell (4) comprising two walls (14*a*, 14*b*) facing each other and defining a recess (C) there between to receive a material to be sintered, a press (2) configured to move one of the walls (14*a*, 14*b*) towards the other wall, so as to compress the material, when the material is received in the recess (C), means for rotating (10*a*, 10*b*) one of the walls (14*a*, 14*b*) relative to the other wall, so as to apply a torsional stress to the material, when the material is compressed in the recess (C)— the two walls (14*a*, 14*b*) movable in relative rotation are upper and lower walls of the sintering cell (4), the sintering cell (4) further comprises two lateral walls (28) facing each other and defining the recess (C) therebetween, the press (2) is configured to move one of the lower (14*a*) and upper (14*b*) walls towards the other of the lower and upper walls, and configured to simultaneously move one of the lateral walls towards the other lateral wall, so as to compress the material along two different directions when the material is received in the recess (C), moving one of the walls (14*a*, 14*b*) towards the other wall, so as to compress the material received in the recess (C), rotating one of the walls (14*a*, 14*b*) relative to the other wall so as to apply a torsional stress to the material compressed in the recess (C).

13. A pulsed-current sintering method according to claim 12, wherein the device comprises a frame (6), the rotating means (10*a*, 10*b*) being also configured to rotate the sintering cell (4) relative to the frame (6).

14. A pulsed-current sintering method according to claim 12, wherein the device comprises a frame (6), the rotating means (10*a*, 10*b*) being configured to rotate the walls (14*a*, 14*b*) relative to the frame (6) in two opposite directions of rotation.

15. A pulsed-current sintering method according to claim 12, wherein the press (2) is configured to move one of the walls (14*a*, 14*b*) in translation towards the other wall parallel to an axis of rotation (Z) of one of the walls (14*a*, 14*b*) relative to the other wall.

16. A pulsed-current sintering method according to claim 12, wherein the two walls (14*a*, 14*b*) have a shape of revolution about an axis of rotation (Z) of one of the walls (14*a*, 14*b*) relative to the other wall.

17. A pulsed-current sintering method according to claim 12, wherein the sintering cell (4) comprises a seal (28) arranged such that the recess (C) is sealingly closed by the seal (28) and the two walls (14*a*, 14*b*).

18. A pulsed-current sintering method according to claim 12, wherein the seal (28) is made of baked pyrophyllite.

19. A pulsed-current sintering method according to claim 12, wherein the press (2) comprises two anvils (10*a*, 10*b*) between which the sintering cell (4) is arranged, at least one of the anvils (10*a*, 10*b*) being movable towards the other anvil so as to come into contact with the sintering cell (4) and move one of the walls (14*a*, 14*b*) towards the other wall so as to compress the material, and the rotating means may comprise the two anvils (10*a*, 10*b*).

20. A pulsed-current sintering method according to claim 12, wherein a movable anvil (10*a*, 10*b*) has a bore (12*a*, 12*b*) and the sintering cell (4) has a protrusion arranged to be received in the bore (12*a*, 12*b*) when the movable anvil (10*a*, 10*b*) is moved towards the other anvil, the bore (12*a*, 12*b*) and the protrusion being of complementary shapes.

21. A pulsed-current sintering method according to claim 12, wherein at least one of the anvils (10*a*, 10*b*) is made of tungsten carbide.

22. A pulsed-current sintering method according to claim 12, wherein the device comprises two electrodes (26*a*, 26*b*) for applying the pulsed current to the material when the material is received in the recess (C), wherein at least one of the electrodes (26*a*, 26*b*) extends through one of the walls (14*a*, 14*b*), and wherein an anvil (10*a*, 10*b*) comprises an electrical conductor arranged to be electrically connected to one of the electrodes (10*a*, 10*b*).

23. A pulsed-current sintering method according to claim 12, wherein:

the two walls (14*a*, 14*b*) movable in relative rotation are upper and lower walls of the sintering cell (4), the sintering cell (4) further comprises two lateral walls (28) facing each other and defining the recess (C) there between;

the press (2) is configured to move one of the lower (14*a*) and upper (14*b*) walls towards the other of the lower and upper walls, and configured to simultaneously move one of the lateral walls towards the other lateral wall, so as to compress the material along two different directions when the material is received in the recess (C).

* * * * *